US005255247A

United States Patent [19]

Moriya

[11] Patent Number: 5,255,247

[45] Date of Patent: Oct. 19, 1993

[54] ELECTRONIC TIMEPIECE INCLUDING INTEGRATED CIRCUITRY

[75] Inventor: Tatsuo Moriya, Suwa, Japan

[73] Assignee: Seiko Epson Corporation, Tokyo, Japan

[21] Appl. No.: 938,974

[22] Filed: Sep. 1, 1992

Related U.S. Application Data

[62] Division of Ser. No. 333,512, Apr. 5, 1989, Pat. No. 5,195,063.

[30] Foreign Application Priority Data

Apr. 6, 1988 [JP] Japan ..... 63-46520

[51] Int. Cl.[5] ..... G04C 19/00; G04F 5/00; G04B 18/00

[52] U.S. Cl. ..... 368/87; 368/157; 368/200

[58] Field of Search ..... 368/155-157, 368/200-202, 85-87

[56] References Cited

U.S. PATENT DOCUMENTS 4,001,553 1/1977 Troutman .
4,150,536 4/1979 Nakajima et al. .
4,254,491 3/1981 Haub et al. .
4,398,832 8/1983 Maire et al. .
4,427,302 1/1984 Watanabe .
4,453,834 6/1984 Suzuki et al. .
4,468,602 8/1984 Antognini et al. .
4,475,180 10/1984 Sekiya et al. .
4,513,259 4/1985 Frerking .
4,538,923 9/1985 Yoshida .
4,644,484 2/1987 Flynn et al. .
4,708,491 11/1987 Luitze .
4,761,771 8/1988 Moriya et al. .
4,763,309 7/1988 DesCombes .

FOREIGN PATENT DOCUMENTS 3031884 4/1982 Fed. Rep. of Germany .
57-139684 11/1982 Japan .
58-223088 12/1983 Japan .
61-47580 3/1986 Japan .

OTHER PUBLICATIONS

B. Gerber "A 1.5 V. Only CMOS EEPROM Based on Fowler-Nordheim Emission Design, Technology and Applications", *International Congress of Chronometry Proceedings*, Oct. 1984.

J. Birkner, "New PROM Architecture Simplifies Microprogramming", *IEE ELECTRO*, vol. 8, 1983.

*Primary Examiner*—Vit W. Miska
*Attorney, Agent, or Firm*—Blum Kaplan

[57] ABSTRACT

An integrated circuit for an electronic timepiece includes at least one semiconductor nonvolatile memory device. Reference data can be checked across a pair of output terminals prior to being stored in at least one EPROM to check the accuracy and acceptability of the reference data for driving a motor of the timepiece. The reference data once written into the EPROM serves as control data. Both the reference data and control data are used for controlling at least one function of the timepiece. The control data also can be checked across the output terminals to determine its accuracy and acceptability for driving the motor. Testing of the reference data and control data can be performed on a faster than real time basis.

18 Claims, 9 Drawing Sheets

10
8
M(N,2,8-1)
M8
EK1
M4
M9
EK2
M5
M10
EK3
M6
M11
EK4
M7
W
WE
WR
RD
WD
OD 13
1309
1310
1311
1312
1313
1314
1315
1316
1317
1318
1319
1320
1321
1322
1323
1324
1325
1326
1327
1301
1302
1303
1304
1305
1306
1307
1308
S01
S02
d̄1
d̄3
d̄5
d̄7
d̄9
d̄2
d̄4
d̄6
d̄8
d̄10
P1
P2
φ16
φ5e
φ1/20
φ1/40
φ1/80
M(4-11)
M(0,2,3)
M1

ELECTRONIC TIMEPIECE INCLUDING INTEGRATED CIRCUITRY

This is a division of U.S. Patent application Ser. No. 07/333,512 filed on Apr. 5, 1989, now U.S. Pat. No. 5,195,063.

BACKGROUND OF THE INVENTION

The invention relates generally to an integrated circuit (IC) for an electronic timepiece, and more particularly to an IC including a semiconductor nonvolatile memory for controlling the function of a timepiece and to improvements in the method of testing the IC after being mounted in the electronic timepiece.

Conventional ICS for electronic timepieces include semiconductor nonvolatile memories such as erasable programmable read-only memories (EPROMs). Testing of the IC is required to determine whether the IC operates in accordance with the data written into the EPROM. Such testing includes writing and erasing data to and from the EPROM every time it is checked.

By using the data stored within an EPROM to control the operation of the IC, the IC becomes multifunctional and has a wide variety of applications. When an IC includes a plurality of EPROMs, testing of almost all possible combinations of data stored in the EPROMS which can be used by the IC is necessary to ensure that no erroneous data has been written into the EPROMS. The time required to test substantially all combinations is extremely long due to the writing and erasing of data to and from each EPROM using conventional test methods. Therefore, not all combinations are tested.

Electronic timepieces loaded with ICs have relatively high production costs stemming from the relatively high expense and reduced production yield associated with such ICs. When the EPROM is of an ultraviolet ray erase type, the erase time is particularly prolonged further aggravating and accentuating the above-noted drawbacks.

Accordingly, it is desirable to provide an EPROM for use with an electronic device such as, but not limited to, an electronic timepiece which can be tested easily and in a relatively short period of time.

SUMMARY OF THE INVENTION

Generally speaking, in accordance with the invention, an integrated circuit for an electronic timepiece includes reference data holding circuitry for holding reference data for use in controlling at least one function of the timepiece; a memory device for storing control data for use in controlling said at least one function of the timepiece; and outputs terminals for receiving at least the reference data to confirm its acceptability for use in driving the timepiece. The integrated circuit also permits transfer of the reference data to the memory device for storage in the memory device as control data. This transfer can occur at the same time or after the reference data has been received by the output terminals.

Accordingly, reference data can be checked at the output terminals of the integrated circuit to determine whether it will properly drive the electronic timepiece prior to being stored in the memory device as well as whether the reference data contains any errors (e.g., caused by noise) prior to being inputted into the memory device.

The memory device preferably includes at least one semiconductor nonvolatile memory such as, but not limited to, an EPROM of the ultraviolet ray erase type.

The timepiece also includes oscillating circuitry for generating oscillating signals for use by the integrated circuit and also includes oscillating compensating circuitry for compensating certain characteristics of the oscillating circuit. The reference data includes, but is not limited to, motor driving and pace regulating information and adjustments to the characteristics of the oscillating circuit.

In another aspect of the invention, an integrated circuit includes reference data holding circuitry f or holding reference data for use in controlling at least one function of the timepiece, a memory device for storing reference data received from the reference data holding circuitry for use in controlling said at least one function of the timepiece and output terminals for receiving the reference data held by the reference data holding circuitry prior to and concurrent with being stored in the memory device. Confirmation as to the accuracy of both the reference data and control data is achieved.

The integrated circuit also includes a data selector for selecting between the control data stored in the memory device and the reference data held by the reference data holding circuitry and a mode counter for establishing at least two test modes. The data selector is operable for selecting the control data during one of the two test modes and for selecting the reference data during the other of the two test modes. The output terminals are operable for receiving the reference data and the control data based on the selection made by the data selector.

The integrated circuit also includes an input/output circuit which permits testing of the timepiece in accordance with the control data and reference data on a faster than real time basis.

In yet another aspect of the invention, the integrated circuit includes a memory device for storing and producing control data, a latch for receiving and holding at least the control data, and motor driving signal forming circuitry for selecting a motor driving signal period and pulse width based on the control data. The latch is also operable for receiving and holding the reference data based on whether the control data or reference data has been selected by the data selector.

Preferably, if more than one memory device is used such as two or more semiconductor nonvolatile devices, the memory devices are disposed parallel to one another with an output data line provided for common use by all the memory devices.

The electronic timepiece having such integrated circuitry permits the integrated circuitry to be tested without rewriting the control data into the memory device by monitoring the reference data held in the reference data holding circuitry. Consequently, the time required for testing the integrated circuit can be substantially shortened.

Accordingly, it is an object of the invention to provide an improved IC for use in an electronic timepiece which is relatively inexpensive, of high-quality, and multifunctional.

It is another object of the invention to provide an improved IC for use in an electronic timepiece which can be tested in a relatively short period of time.

It is a further object of the invention to provide an improved electronic timepiece using ICs which has a high level of performance and is relatively inexpensive compared to conventional electronic timepieces employing ICs.

Still other objects and advantages of the invention will in part be obvious and will in part be apparent from the specification.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENT

Figure 1:
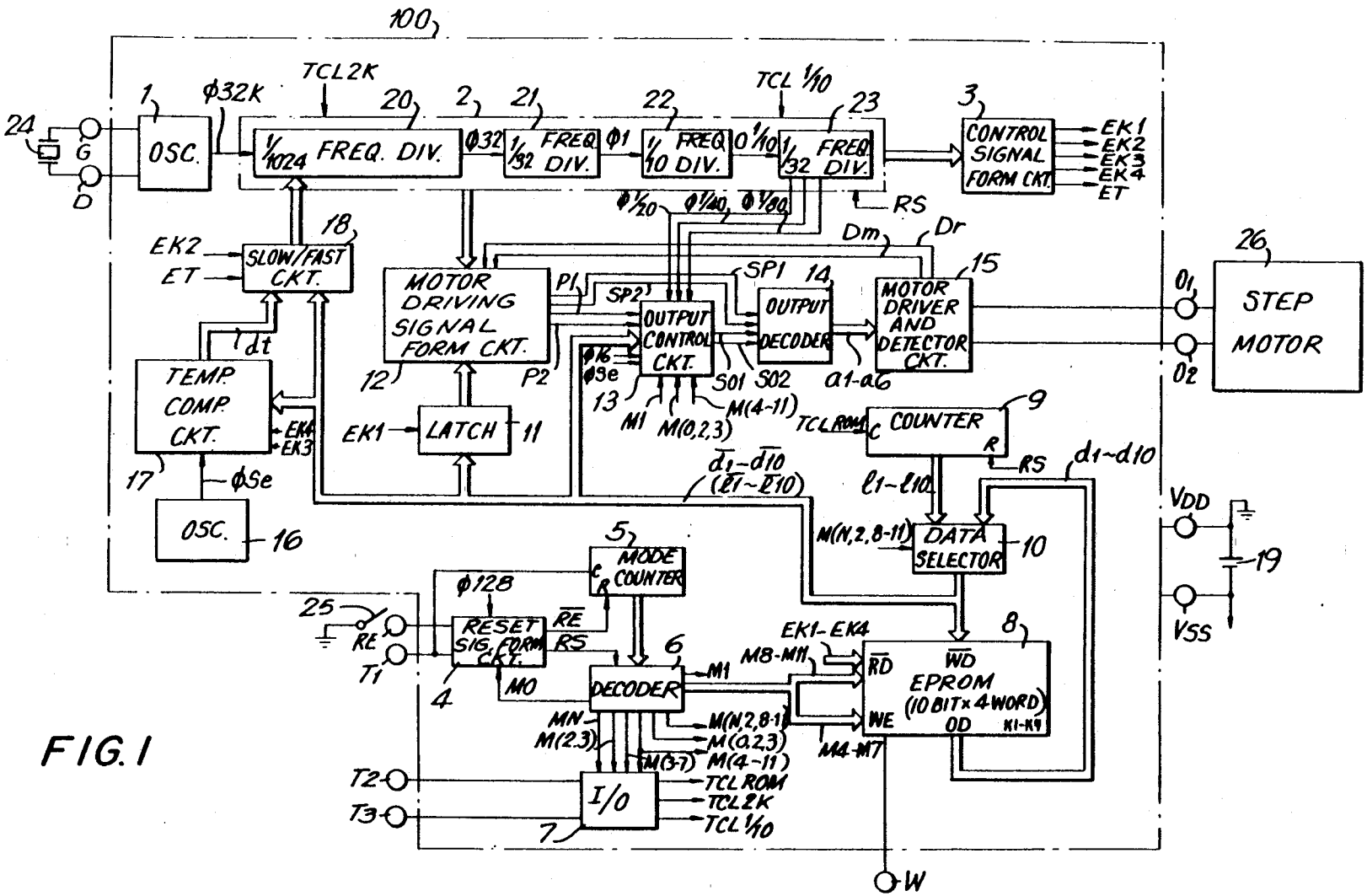
FIG. 1 is a block diagram of electronic timepiece including an IC in accordance with the invention.

FIG. 1 is a block diagram of an electronic timepiece which includes an IC 100. IC 100 is powered by a battery 19. Battery 19 is connected to a pair of terminals VDD, Vss of IC 100. A description of each component within IC 100 will be initially discussed followed by a description as to the operation of the electronic timepiece.

An oscillation circuit 1 of IC 100 produces an oscillating signal $\phi$32 K at a frequency of approximately 32,768 Hz with a tuning fork crystal resonator 24 serving as a source of oscillation. Turning fork crystal resonator 24, which exhibits secondary temperature characteristics, is connected to terminals G, D of IC 100.

A frequency divider circuit 2 of IC 100 includes a 1/1024 frequency divider circuit 20 operable for dividing the 32,768 Hz oscillating signal $\phi$32 K produced by oscillation circuit 1 into a 32 Hz signal $\phi$32. Frequency divider circuit 2 also includes a 1/32 frequency divider circuit 21 operable for dividing signal 100 32 into a 1 Hz signal $\phi$1. A 1/10 frequency divider circuit 22 and a 1/32 frequency divider circuit 23 of frequency divider circuit 21 are operable for dividing signal $\phi$1 into a 1/10 Hz signal $\phi$1/10 and for dividing signal $\phi$1/10 into a 1/32O Hz signal $\phi$1/320, respectively.

Figure 2:
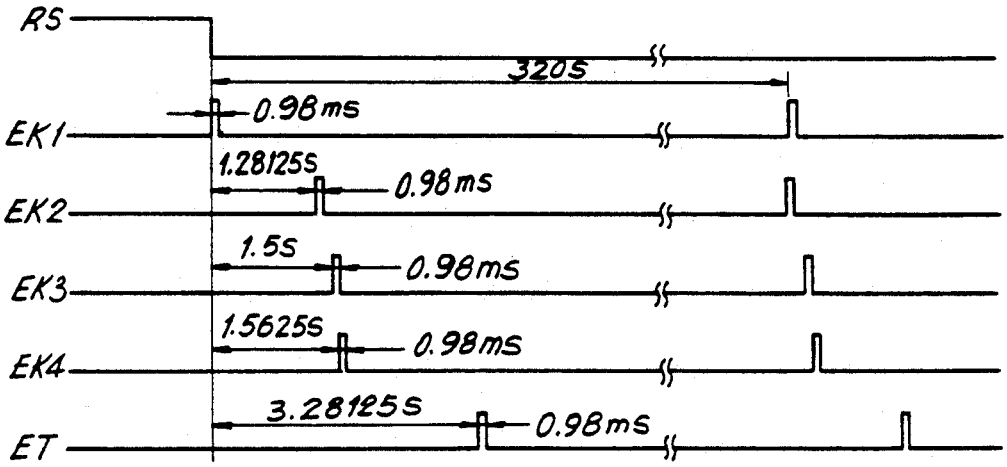
FIG. 2 is a timing chart of signals produced by a control signal forming circuit.

A control signal forming circuit 3 produces combinations of signals at various frequencies based on the output of frequency divider circuit 2 using conventional logic gate circuitry, well known in the art. The outputs of control signal forming circuit 3 include control signals EK1, EK2, EK3, EK4 and ET illustrated in the timing chart of FIG. 2. Also shown in FIG. 2 is a reset signal RS for resetting frequency divider circuit 2 to its initial state. Concurrent with the trailing edge of reset signal RS, control signal forming circuit 3 outputs signal EK1 having a periodic pulse of width 0.98 ms every 320 seconds. Signals EK2, EK3, EK4 and EK are similar to signal EK1 except delayed by 1.28125, 1.5, 1.5625 and 3.28125 seconds after the trailing edge of reset signal RS occurs, respectively.

Figure 3:
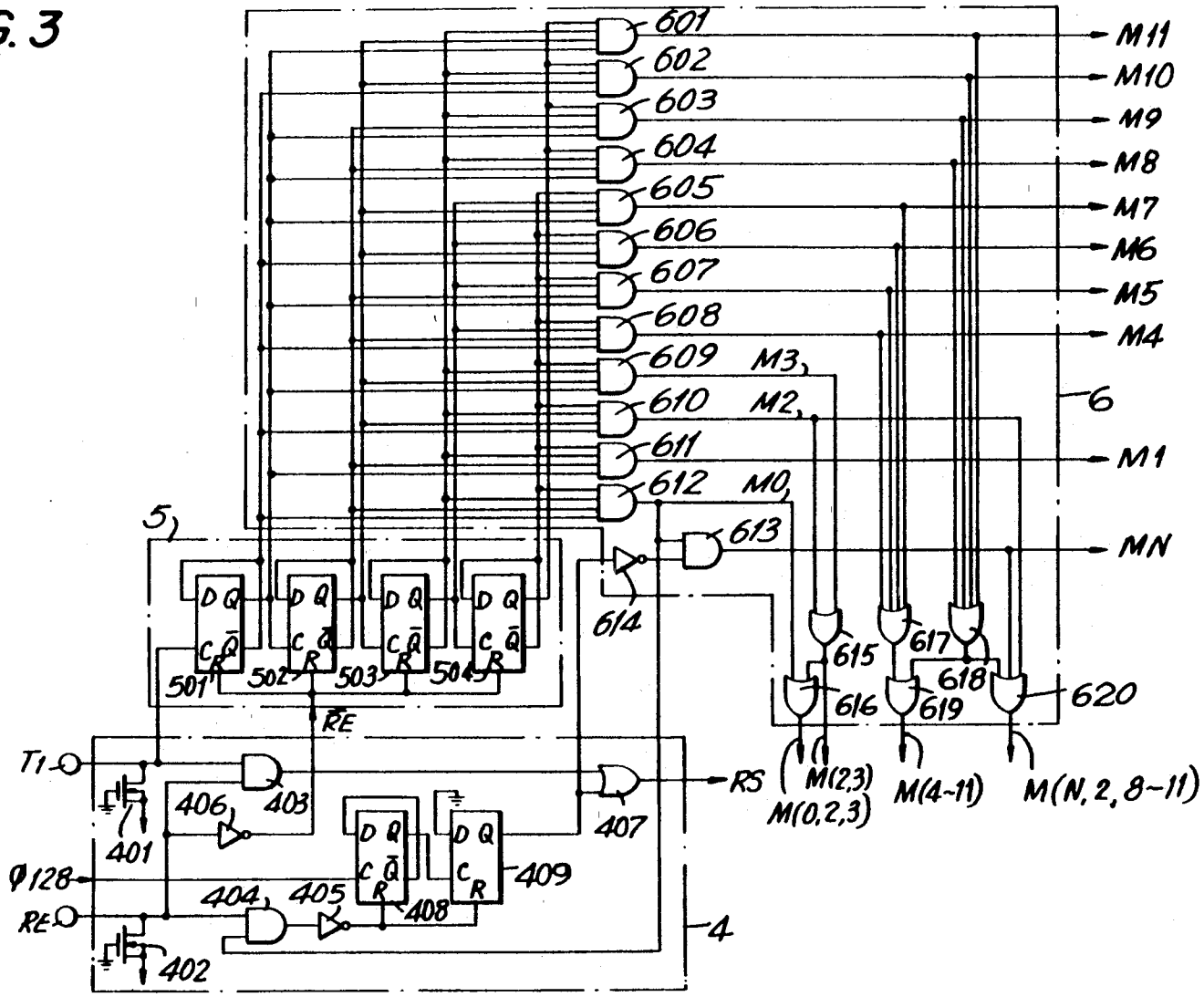
FIG. 3 is a circuit diagram of a reset signal forming circuit, a mode counter and a decoder of FIG. 1.

As shown in FIG. 3, a reset signal forming circuit 4 includes N-channel type MOS transistors 401 and 402 for pulling down a pair of terminals T1 and RE of IC 100 to a low logic level, a pair of AND gates 403 and 404, a pair of inverters 405 and 406 and an OR gate 407. Circuit 4 also includes two D-type flip-flops (hereinafter referred to as F.F.) 408 and 409 having their respective reset terminals (R) connected together. F.F. 408 and 409 are arranged synchronously with leading edge of clock signal applied to their respective c terminals to transfer to their respective terminals Q the signals applied to their respective D terminals which are synchronous with the leading edge of a clock signal $\phi$128. Clock signal $\phi$128 is applied to clock terminal c of F.F. 408 and is produced by frequency divider 2.

As shown in FIG. 1, reset signal forming circuit 4 outputs signal RS for use in resetting the frequency divider 2 to its initial state. Reset signal RS is outputted after a passage of 7.8 ms–15.6 ms followed by the closing of a reset switch 25 until the period of time a pulse being applied to terminal T1. Reset switch 25 interlocks a regulating lever for regulating a time display ring train when the time displayed by the timepiece is being adjusted. On the instant that a pulse is applied to the terminal T1 when the terminal RE is high at a high logic level. The reset signal forming circuit 4 also outputs a signal RE for resetting a mode counter 5 when terminal RE is low (i.e. when reset "switch 25 is opened).

As shown in FIG. 3, mode counter 5 includes D-type F.F.s 501, 502, 503 and 504 having their respective reset terminals connected together and are reset when the signal RE is at a high logic level (i.e. when reset switch 25 is closed). Mode counter 5 counts the number of pulses applied to terminal T1.

A decoder 6, shown in FIG. 3, includes AND gates 601–613 an invertor 614, and OR gates 615–620. The outputs of AND gates 601–608, 611 and 613 produce mode signals M11–M4, M1 and MN, irrespectively. The outputs of AND gates 609, 610 and 612 produce mode signals M3, M2 and MO, respectively. Based on the value of mode counter 5 and the logic level of reset signal RS, mode signals MN and M1–M11 assume different logic levels. Mode signal MN reflects when terminal RE is at a low logic level. Mode signals M0–M11 represent the number of pulses applied to terminal T1 after terminal RE is at a high logic level.

The outputs of OR gates 615, 616, 619 and 620 also represent in combination the logic levels of mode signals MN and M2–M11. More particularly, an output signal M(2, 3) produced by OR gate 615 reflects whether mode signals M2 or M3 are at a high logic level. An output signal M(0, 2, 3) produced by OR gate 616 represents whether mode signal M0, M2 or M3 is at a high logic level. An output signal M(4–11) produced by OR gate 619 represents whether mode signal M4–M10 or M11 is at a high logic level. An output signal M(N, 2, 8–11) produced by OR gate 620 represents whether mode signal MN, M2, M8–M10 or M11 is at a high logic level.

Figure 4:
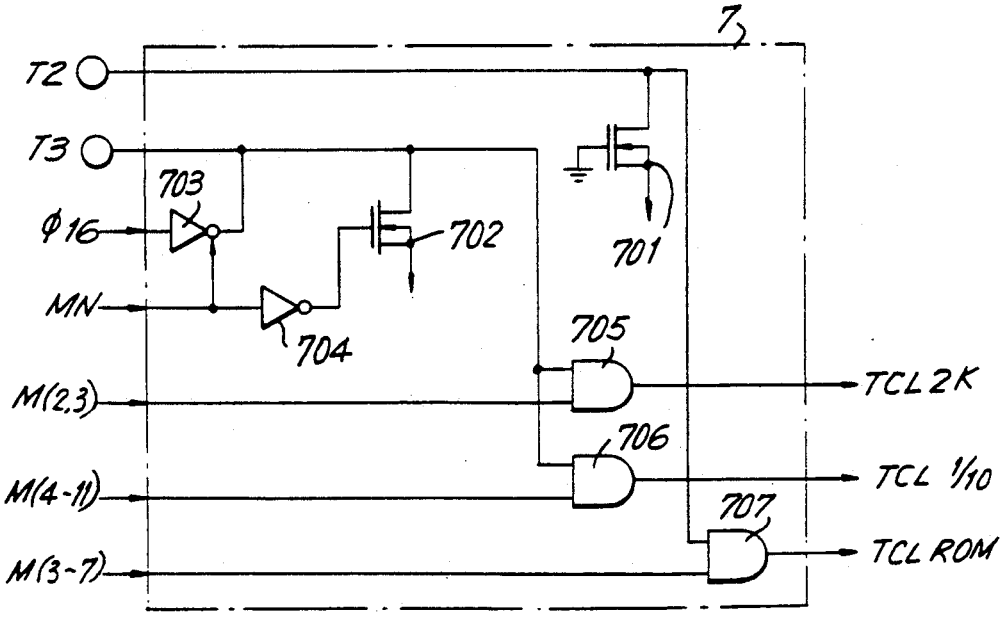
FIG. 4 is a circuit diagram of an input/output control circuit of FIG. 1.

As shown in FIG. 4, input/output control circuit 7 includes two N-channel type MOS transistors 701 and 702 for pulling down a pair of corresponding terminals T2 and T3. Circuit 7 also includes a clock invertor 703 for inverting a clock signal 016, an invertor 704 for inverting mode signal MN and three AND gates 705, 706 and 707. Input/Output control circuit 7 can supply a data clock signal (TCLROM) received by an EPROM data counter 9 at terminal T2 when mode signals M (3–7) (i.e. M3, M4, M5, M6 or M7) are at a high logic level. Application of a 16 Hz signal $\phi$16 to terminal T3 is used to monitor the pace at which IC 100 is tested. For example, a test clock signal (TCL2K) supplied to terminal T3 and outputted by AND gate 705 can be used to provide acceleration equivalent to a 2,048 Hz signal $\phi$2048 of frequency divider circuit 2 when mode signals M(2, 3) (i.e. M2 or M3) are at a high logic level. Alternatively, a test clock signal (TCL 1/10) can be supplied to terminal T3 and outputted by AND gate 700 when mode signals M(4–11) (i.e. M4–M10 or M11) are at a high level. Signal TCL 1/10 is equivalent to a 1/10 Hz signal $\phi$1/10 and is also received by frequency divider circuit 2.

Figure 5:
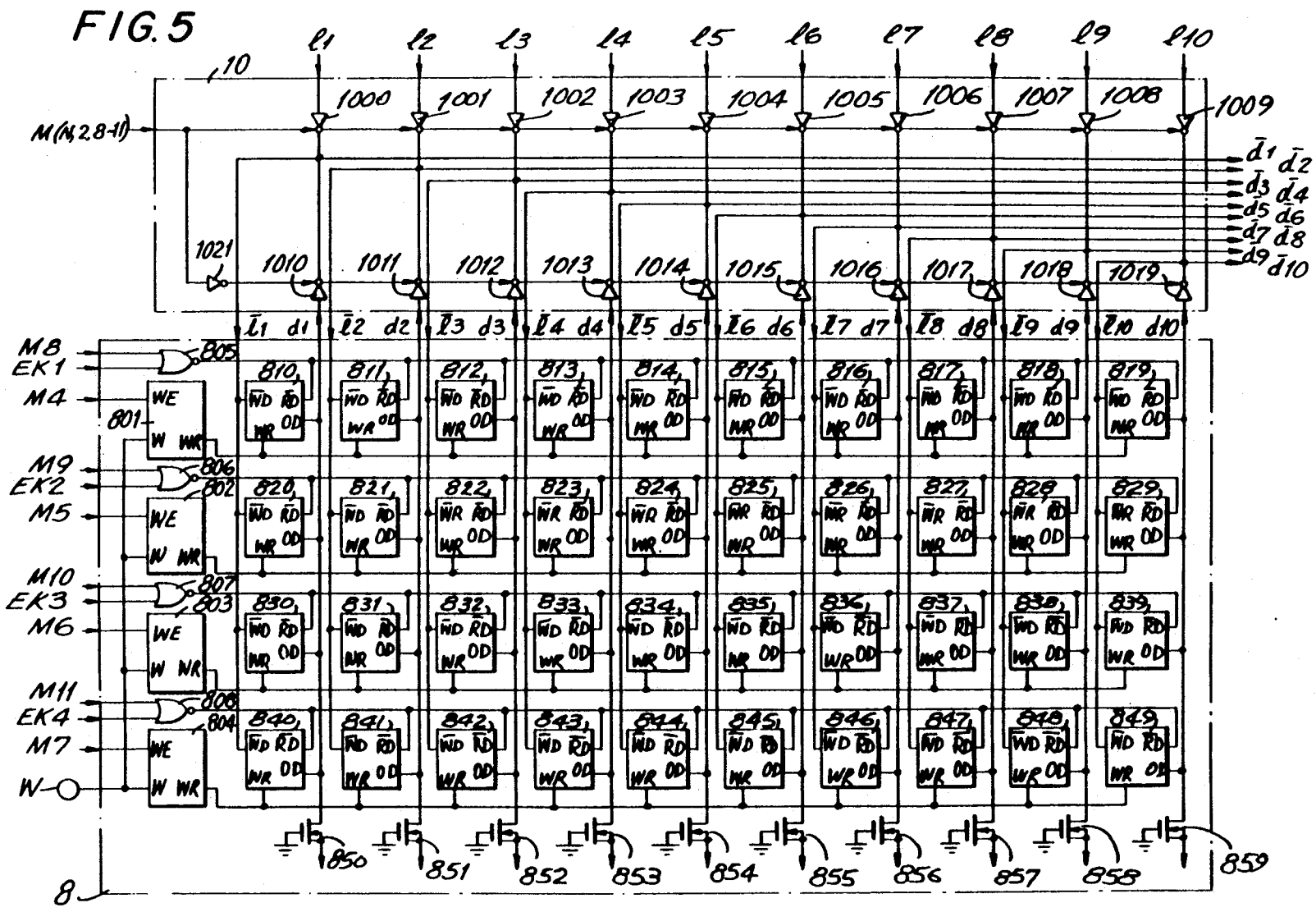
FIG. 5 is a circuit diagram of an EPROM and a data selector of FIG. 1.

A 10 bit×4 word EPROM 8 of an ultraviolet ray erase type is shown in FIG. 5. EPROM 8 includes a plurality of write enable blocks 801–804, NOR gates 805–808, ROM blocks 810–849, and N-channel type MOS transistors 850–589. Application of approximately −30 V at a voltage level of $V_{DD}$ to a terminal W when mode signal M4 is at a high logic level results in ten signals 11, l2, l3–l10 of reference data (hereinafter referred to as reference signal/data L) supplied by EPROM data counter 9 being written into ROM blocks 810–819 as a motor driving control data signal K1. Application of approximately −30 V at a voltage level $V_{DD}$ to terminal W when mode signal M5 is at a high logic level results in reference signal L supplied by EPROM data 9 being written into ROM blocks 820–829 as a pace regulating signal K2. Application of approximately −30 V voltage level $V_{DD}$ to terminal W when mode signal M6 is at a high logic level results in reference signal L supplied by EPROM data 9 being written into ROM blocks 830–839 as a data signal K3 for use in adjusting the inclination of a temperature sensitive oscillation circuit 16. Application of approximately −30 V at voltage level $V_{DD}$ to terminal W when mode signal M7 is at a high logic level results in reference signal L supplied by EPROM data 9 being written into ROM blocks 840–849 as a data signal K4 for use in adjusting the offsetting of temperature sensitive oscillation circuit 16.

When mode signal M8 or control signal EK1 is at a high logic level, motor driving control data signal K1 is produced by (read out of) ROM blocks 810–819. When mode signal M9 or control signal EK2 is at a high logic level, pace regulating signal K2 is read out of ROM blocks 820–829. When mode signal M10 or control signal EK3 is at a high logic level, data signal K3 is read out of ROM blocks 830–839. When mode signal M11 or control signal EK4 is at a high logic level, data signal K4 is produced by ROM block 840

Figure 6:
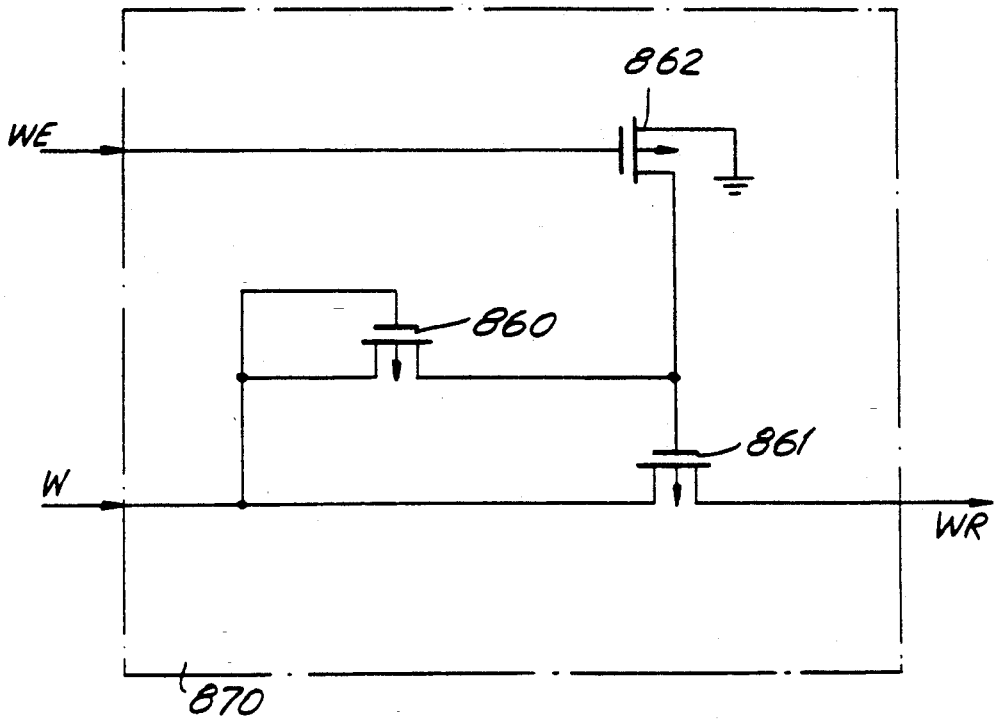
FIG. 6 is a circuit diagram of a write enable block of FIG. 5.

A write enable block 870 representing one of the four write enable blocks 801–804 of EPROM 8 is shown in FIG. 6. Block 870 includes a pair of high voltage withstanding P-channel type: MOS transistors 860 and 861 and an ordinary P-channel type MOS transistor 862. A high voltage applied to a write terminal W is produced at a write terminal WR of block 870 only when the signal applied to an enabling terminal WE is at a high logic level.

Figure 7:
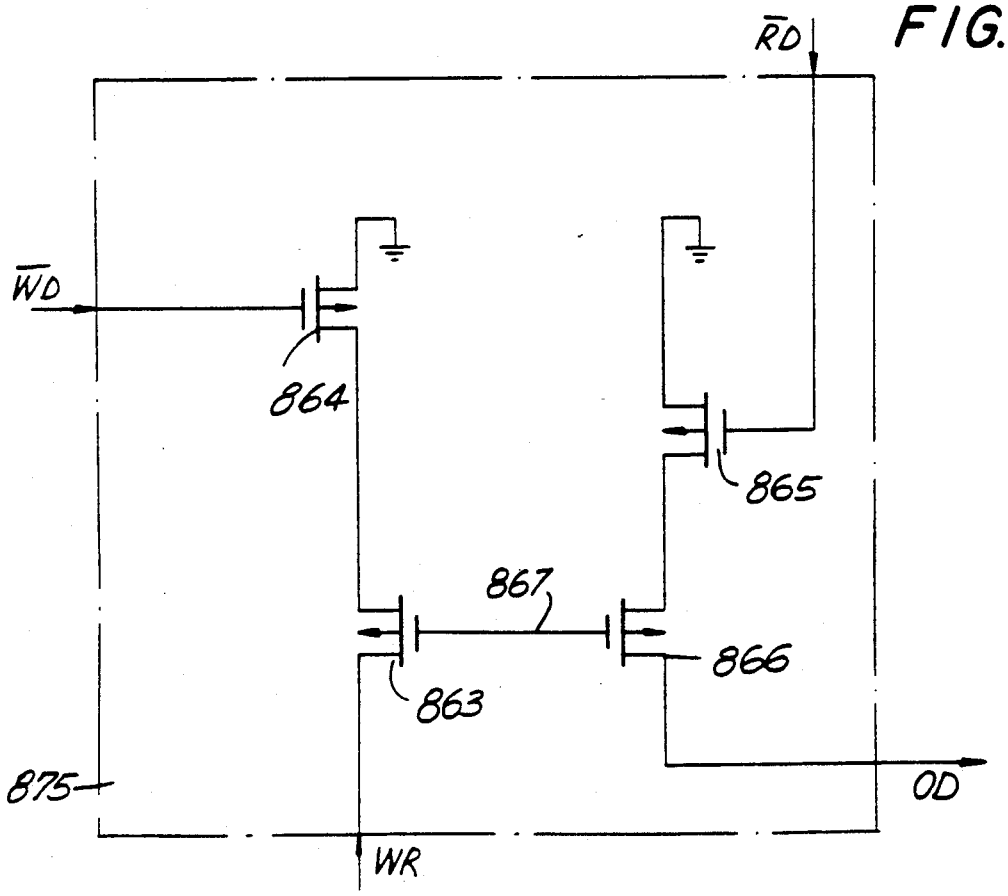
FIG. 7 is a circuit diagram of a ROM block of FIG. 5.

A ROM block 875 representing one of ROM blocks 810–849 is shown in FIG. 7. ROM block 875 includes two P-channel type MOS transistors 863 and 864 for data writing and two P-channel type MOS transistors 865 and 866 for data calling. When a negative high voltage is applied to a terminal WR while the data signal applied to a terminal $\overline{WD}$ remains at a low logic level, current flows into a gate 867 of transistors 863 and 866 which turns on transistor 866 causing data "1" (i.e. high logic level) to be written. A high logic level is stored by ROM block 875 and is supplied to a terminal OD only when the read signal at a terminal $\overline{RD}$ is at a low logic level (i.e. RD is at a high logic level).

Referring once again to FIG. 1, EPROM data counter 9 for EPROM data writing includes a 10 bit flip-flop and counts a data clock signal TCLROM supplied to a terminal C and simultaneously produces a count value as reference signal L. Counter 9 is reset by reset signal RS applied to a terminal R.

A data selector 10, shown in FIG. 5, produces a plurality of data signals $\overline{d}_1$–$\overline{d}_{10}$ and includes a plurality of clock inverters 1000–1019 and an invertor 1021. Reference signal L of counter 9 for EPROM data writing is selected as data signals $\overline{d}_1$–$\overline{d}_{10}$ when mode signals M (N, 2, 8–11) are at a high logic level. Selection of output data K (i.e. K1, K2 K3 or K4) of EPROM 8 as data signals $\overline{d}_1$–$\overline{d}_{10}$ is made when mode signals M (N, 2, 8–11) are at a low logical level.

Figure 9:
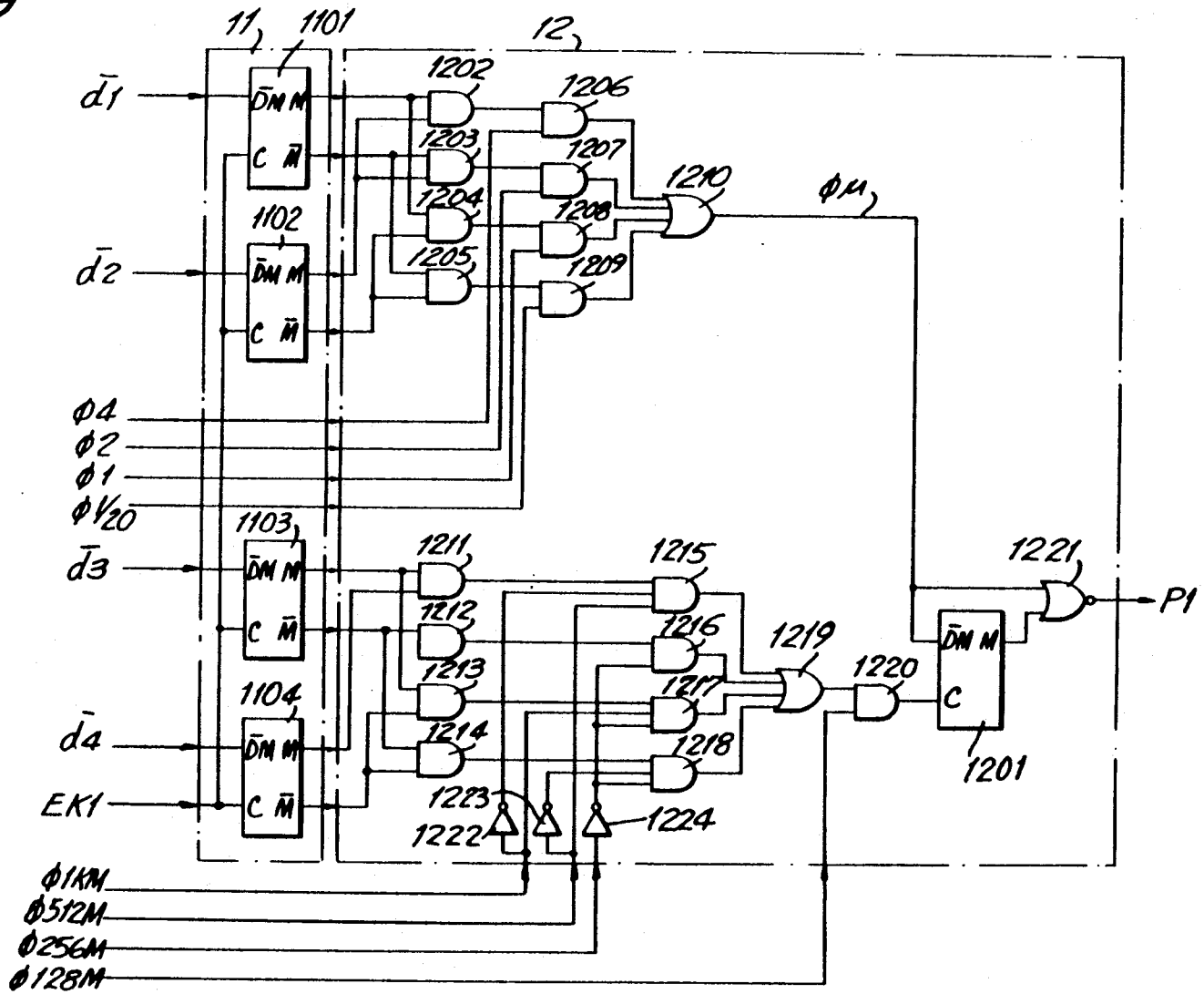
FIG. 9 is a circuit diagram of a latch circuit and the motor driving signal forming circuit of FIG. 1.

As shown in FIG. 9, a latch circuit 11 includes four D-type latches 1101–1104 and holds the data selected by data selector 10. Control signal EK1 serves as the clock signal for latch 11. Latch 11 clocks in data from data selector 10 concurrent with the leading edge of control signal EK1 (i.e. as control signal EK1 rises).

Figure 8:
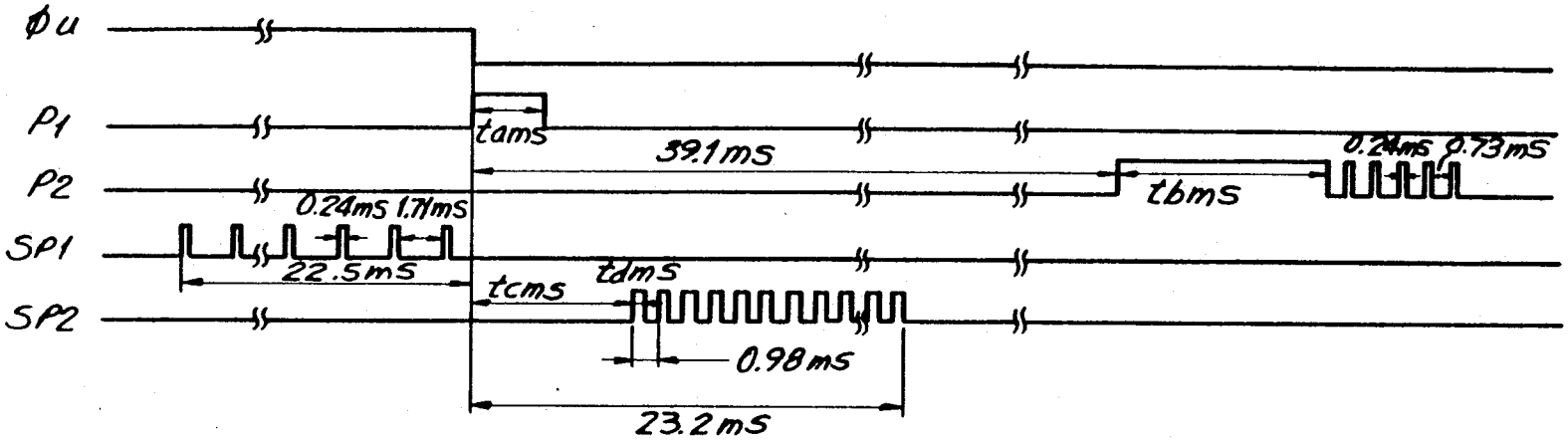
FIG. 8 is a timing chart of signals produced by a motor driving signal forming circuit of FIG. 1.

Shown in FIG. 8 are several signals produced within an at the output of a motor driving signal forming circuit 12. Circuit 12 forms and outputs a needle operating period $\phi$u of a step motor 26 (see FIG. 1), a driving pulse P1 having a pulse width ta which occurs during normal operation of the electronic timepiece, a driving pulse P2 having a pulse width $t_b$ and applied when rotation of the motor is undetected, an AC magnetic field detecting pulse SP1, and a pulse SP2 having pulse widths $t_d$ and applied when rotation of the motor is detected. Pulse widths $t_a$, $t_b$ and $t_d$ are in milliseconds.

Referring once again to FIG. 9, an electrical schematic of the needle operating period $\phi$u of the motor driving signal forming circuit 12 is shown with driving pulse P1 during normal operation. circuit 12 includes a D-type latch 1201 which holds data supplied to a terminal $\overline{D}$m when the signal is applied to a clock terminal C. Circuit 12 also includes a plurality of AND gates 1202–1209, 1211–1218 and 1220, two OR gates 1210, 1219, a NOR gate 1221, and three inverters 1222–1224. Signals $\phi$1KH, $\phi$512m, $\phi$256M, $\phi$128M represent master signals produced from respective Frequency stages of frequency divider circuit 2 and used to form pulse width of driving pulse P1. Signals $\phi$4, $\phi$2, $\phi$1 and $\phi$20 are produced by frequency divider circuit 2 and used to form needle operating period $\phi$u. Driving pulse P1 is based on data signals $d_1$, $d_2$, $d_3$, $d_4$. Table 1 lists needle operating period $\phi$u based on the possible logical values of data signals $d_1$ and $d_2$ with data signal K1 stored in EPROM 8 having been selected by data selector 10.

TABLE 1

| $d_2$ | $d_1$ | $\phi u$ (sec.) |
|---|---|---|
| 0 | 0 | 20 |
| 0 | 1 | 1 |
| 1 | 0 | 1/2 |
| 1 | 1 | 1/4 |

Table 2 lists the values of pulse width $t_a$ of driving pulse P1 based on the possible logic values of data signals d3 and $d_4$ with data signal K1 stored in EPROM 8 having been selected by data selector 10.

TABLE 2

| $d_4$ | $d_3$ | $t_a$(ms) |
|---|---|---|
| 0 | 0 | 3.42 |
| 0 | 1 | 3.17 |
| 1 | 0 | 2.93 |
| 1 | 1 | 2.69 |

Motor driving signal forming circuit 12 produces driving pulse P2 having pulse widths $t_b$ when rotation of step motor 26 is undetected using conventional logic gate circuitry, well known in the art. Table 3 lists the values of pulse widths $t_b$ of driving pulse P2 based on the possible values of data signals $d_5$ and $d_6$ with data signal K1 having been selected by data selector 10.

TABLE 3

| $d_6$ | $d_5$ | $t_b$(ms) |
|---|---|---|
| 0 | 0 | 7.81 |
| 0 | 1 | 6.84 |
| 1 | 0 | 5.86 |
| 1 | 1 | 4.88 |

Table 4 lists the values of a period of time $t_c$ (in milliseconds) of rotation detecting pulse SP2 when rotation of step motor 26 is detected based on the logic values of data signals $d_7$ and $d_8$ and with data signal K1 stored in EPROM 8 having been selected by data selector 10.

TABLE 4

| $d_8$ | $d_7$ | $t_c$(ms) |
|---|---|---|
| 0 | 0 | 7.81 |
| 0 | 1 | 6.84 |
| 1 | 0 | 5.86 |
| 1 | 1 | 4.88 |

Table 5 lists the values of pulse widths $t_d$ of rotation detecting pulse SP2 based on the logic values of data signals $d_9$ and $d_{10}$ with data signal K1 stored in EPROM 8 having been selected by data selector 10.

TABLE 5

| $d_{10}$ | $d_9$ | $t_d$(ms) |
|---|---|---|
| 0 | 0 | 0.73 |
| 0 | 1 | 0.49 |
| 1 | 0 | 0.24 |
| 1 | 1 | 0.12 |

Conventional logic gate circuitry, well known in the art, is used to produce AC magnetic field detecting pulse SP1 and rotation detecting pulse SP2. Pulses SP1 and SP2 are not produced at the instant that a rotation detecting signal Dr and an AC magnetic field detecting signal Dm assume a high logic level. A motor driver and detection circuit 15 is operable for halting the detecting operation until the next period of rotation and produces both signals Dr and Dm as discussed below. Moreover, driving pulse P2 applied at the time of non-rotation of the motor is applied only when rotation detecting signal Dr assumes a high logic level (i.e. when rotation of the motor is undetected).

Figure 10:
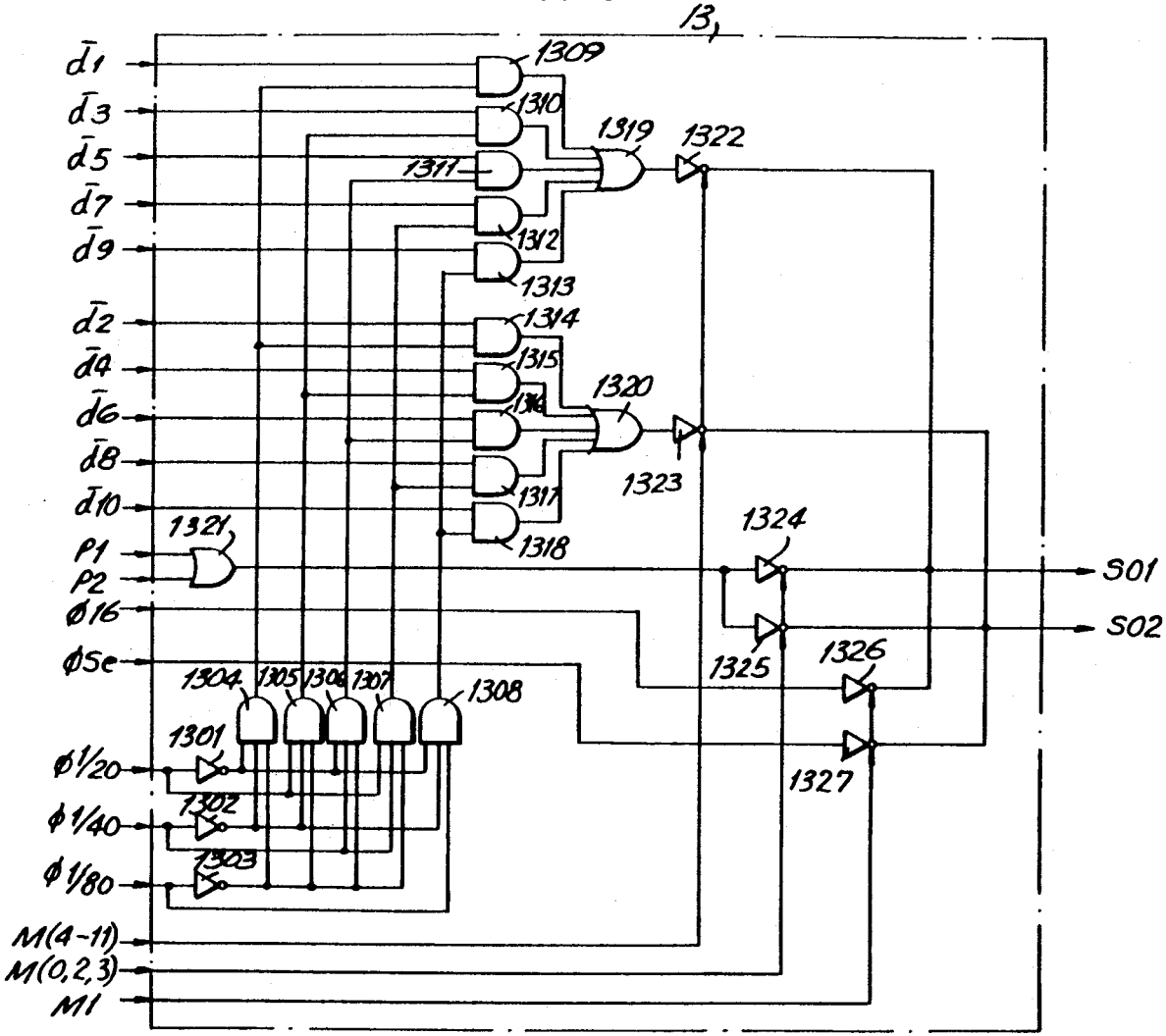
FIG. 10 is a circuit diagram of an output control circuit of FIG. 1.

An output control circuit 13, shown in FIG. 10, includes a plurality of inverters 1301–1303, AND gates 1304–1318, OR gates 1319–1321, and clocked inverters 1322–1327. When mode signals M (0, 2, 3) (i.e. mode signals M0, M2 or M3) are at a high logic level, output control circuit 13 produces motor driving pulses represented by a pair of signals S01 and S02. Signal S01 corresponds to the output state of an output terminal 01 of motor driver and detection circuit 15 shown in FIG. 12. Signal S02 corresponds to the output state of an output terminal 02 of motor drive and detection circuit 15 also shown in FIG. 12. When mode signal M1 is at a high logic level, output control circuit 13 produces a 16 Hz signal $\phi$16 as signal S01 and the output signal of temperature sensitive oscillation circuit 16 serves as signal S02. When mode signals M (4–11) (i.e. M4–M10 or M11) are at a high logic level, output control circuit 13 produces the combination of data signals d1, d3, d5, d7 and d9 as signal S01 and the combination of data signals d2, d4, d6, d8 and d10 as signal S02 based on signals $\phi$1/20, $\phi$1/40 and $\phi$1/80. These three signals are produced from the 1/32 frequency divider circuit 23 of frequency divider circuit 2.

Figure 11:
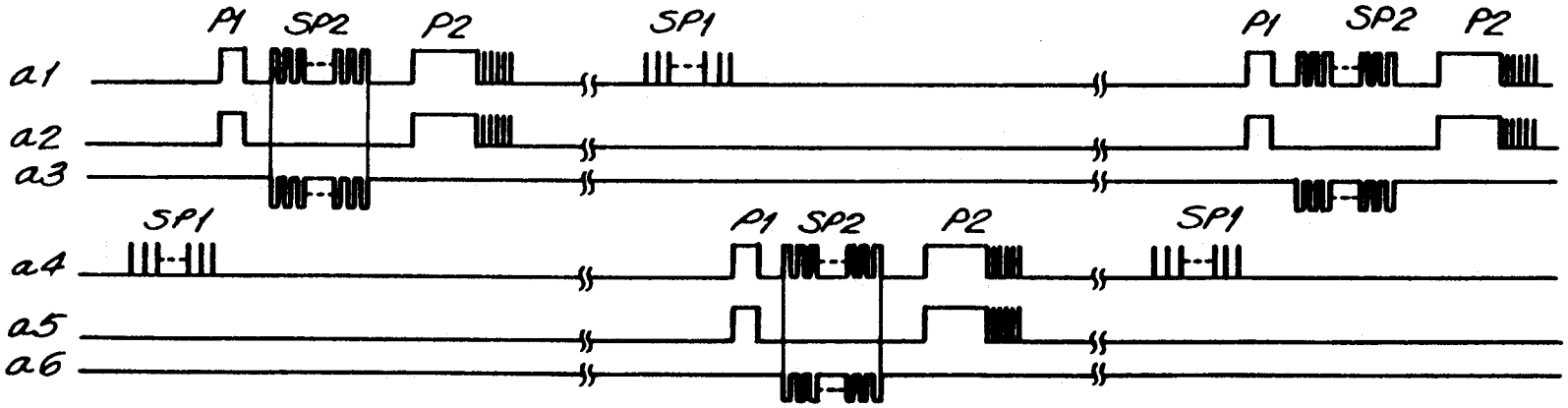
FIG. 11 is a timing chart of signals produced by an output decoder of FIG. 1.

An output decoder 14 decodes motor driving pulses P1, P2 and detection signals SP1, SP2 produced by motor driving signal and detection signal forming circuit 12 and outputs a plurality of signals a1–a6 as shown in the timing chart of FIG. 11 using conventional logic gate circuitry, well known in the art. Signals SP1, SP2 are supplied to decoder 14 only when mode signals M (0, 2, 3) (i.e. M0, M2 or M3) are at a high logic level.

Figure 12:
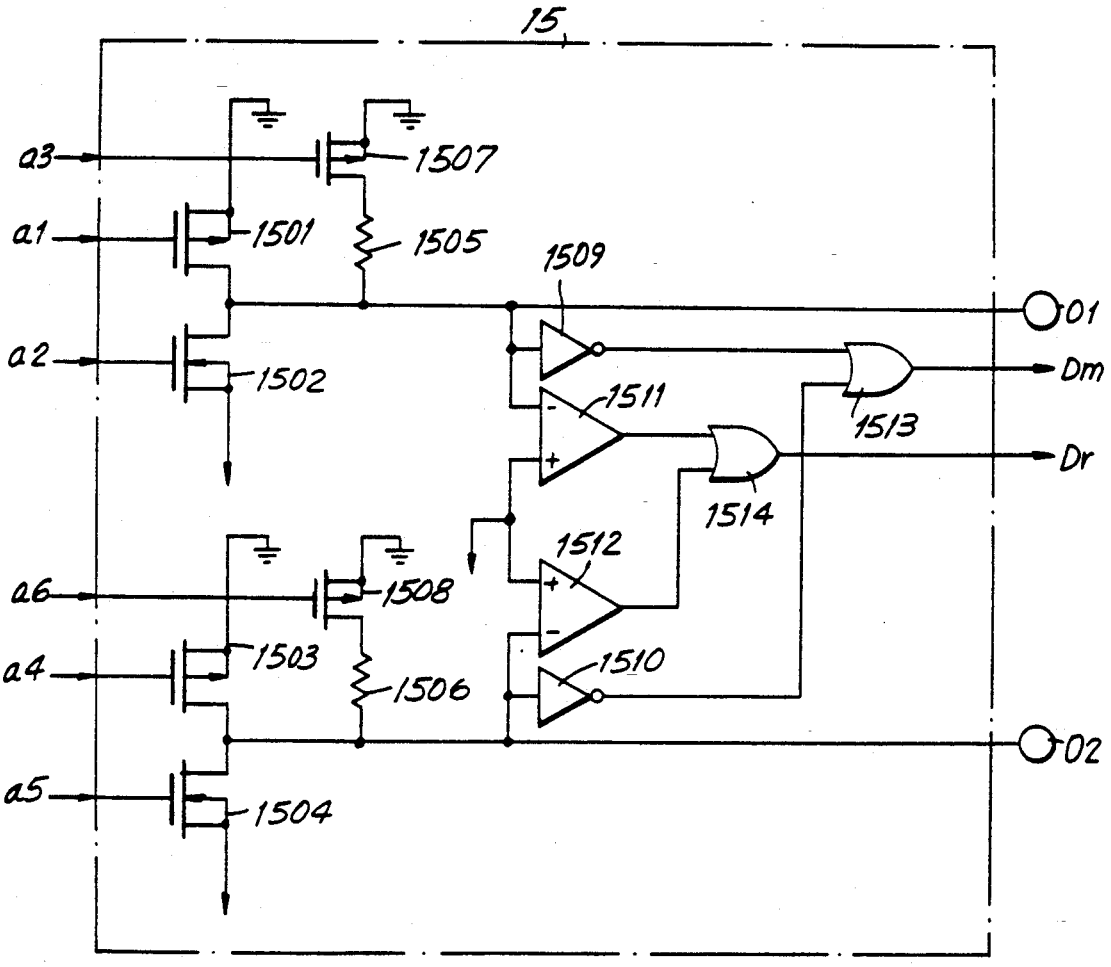
FIG. 12 is a circuit diagram of a motor driving signal and detection signal forming circuit of FIG. 1.

As shown in FIG. 12, motor driver and detection circuit 15 receives signals a1–a6 and includes as a motor driver two P-channel type MOS transistors 1501 and 1503 and two N-channel type MOS transistors 1502 and 1504. Circuit 15 also includes a pair of rotation detecting resistors 1505 and 1506 and a pair of P-channel type MOS transistors 1507 and 1508 for switching the connection of rotation detecting resistors 1505 and 1506. A pair of inverters 1509 and 1510 produce high logic levels when the voltage delivers to terminal 01 and 02 at the time the AC magnetic field is detected drops below 0.6 V. Two comparators 1511 and 1512 assume high logic levels when the voltage delivered to their respective inverting inputs at the time rotation of the motor is detected exceeds the power supply voltage. The outputs of comparator 1511 and 1512 are connected to the inputs of an OR gate 1514. The output of OR gate 1514 produces signal Dr. The outputs of inverters 1509 and 1510 are connected to the inputs of an OR gate 1513. The output of 0R gate 1513 produces signal Dm.

Motor driver and detection circuit 15 provides to output terminals 01, 02 a motor driving pulse for driving step motor 26 included in a display mechanism and produces AC magnetic field detecting signal Dm and rotation detecting signal Dr (which assumes a high logic level). when the detection voltage generated at a coil end of step motor 26 and AC magnetic field detecting pulse SP1 and rotation detecting pulse SP2 are applied. Comparators 1511 and 1512 are adapted to operate when rotation is detected so that the power consumption is reduced.

Temperature sensitive oscillation circuit 16 produces an oscillating signal $\phi se$ defined as:

$$f=AO+B \ldots \quad \text{(eq. 1)}$$

where f=frequency, O=temperature, A=constant of inclination and B=constant offset adjustment.

A temperature compensating circuit 17 produces a fast/slow data dT for compensating the secondary temperature characteristics of oscillation circuit 1. A method of forming fast/slow data dT is as follows.

A pace y relative to temperature 0 is approximated by the following equation when oscillation circuit 1 is not compensated for:

$$y=-b\cdot(O-To)^2+a \ldots \quad \text{(eq. 2)}$$

where a=apex pace, b=secondary temperature coefficient; Ot=apex temperature. From the eqs. 1 and 2, it is understood that the pace y relative to oscillating frequency f of temperature sensitive oscillation circuit 16 is approximated as follows when oscillation circuit 1 is not compensated:

$$y=-B\cdot(f-ft)^2+a \ldots \quad \text{(eq. 3)}$$

where $B=b/A^2$, ft=oscillating frequency of temperature sensitive circuit 16 at apex temperature Ot.

Based on eq. 3 compensation of the oscillating frequency of oscillation circuit 1 by $B\cdot(f-ft)^2$ for increasing the compensation (onto the gaining side when it is f), i.e., the slow/fast data dt is expressed as $$dt=[B\cdot(f-ft)^2/c] \ldots \quad \text{(eq. 4)}$$

given the minimum resolution of a logical slow/fast circuit 18 is c, should only be supplied to logical slow/-fast circuit 18 to make flat the secondary temperature characteristics of oscillation circuit 1. In this case, [ ] signifies conversion to integers.

The temperature compensating circuit 17 gains an inclination adjusting value K3 set by B of eq. 4 and an offset adjusting value K4 set by ft of eq. 4 from EPROM 8 when control signals EK3, EK4 each are at high logic level. Circuit 17 provides the inclination and offset adjustment of $\phi se$ produced from the temperature sensitive oscillation circuit 16 using, for example, the methods disclosed in Japanese Patent Publications laid open Nos. 223088/1983 and 47580/1986, incorporated herein by reference thereto, and outputs the slow/fast data dt expressed by eq. 4.

A logical slow/fast circuit 18 receives from EPROM 8 pace adjusting data K2 for compensating apex pace a of eq. 2 when control signal EK2 is high and sets the 1/1024 frequency divider circuit 20 in a gaining or decrementing state of compensation determined by signal K2. Circuit 18 also receives temperature compensating slow/fast data dt produced by temperature compensating circuit 17 when a control signal ET is at a high logic level to set the 1/1024frequency divider circuit 20 in a gaining state determined by data dt.

With each component of FIG. 1 now having been described, operation of the analog electronic timepiece is as follows.

IC 100 for the analog electronic timepiece and the analog electronic timepiece embodying the present invention are so arranged that the control of their mode depends on the state of the reset switch 25 (terminal RE) and the number of pulses applied to the terminal T1 after reset switch 25 is closed.

While reset switch 25 remains opened the normal mode is established and the mode signals MN, M(N, 2, 8–11), M(0, 2, 3) assume high logic levels. Input/output control circuit 7 produces 16 Hz signal 016 to monitor the pace at terminal T3 and data selector 10 selects the data stored in EPROM 8. Output control circuit 13 selects and delivers a motor driving pulse. When signal EK1, produced by control signal forming circuit 3, is at a high logic level motor driving signal control data K1 is produced from (read out of) EPROM 8 and simultaneously latch circuit 11 obtains the value of signal K1.

Motor driving signal forming circuit 12 produces a motor driving pulse and a detecting pulse with the needle operating period having a pulse width determined by motor driving signal control data K1. When signal EK2, produced by control signal forming circuit 3, is at a high logic level pace adjusting data K2 is produced by EPROM 8. Simultaneously, logical slow/fast circuit 18 receives pace adjusting data K2 to flexibly set the 1/1024 frequency divider circuit 20 in a gaining or losing state of compensation based on pace adjusting data K2. When signals EK3 and EK4, produced from the control signal forming circuit 3, are at a high logic level EPROM 8 outputs inclination adjusting data K3 and offset adjusting data K4. Temperature compensating circuit 17 receives inclination adjusting data K3 and offset adjusting data K4 and outputs temperature compensating fast/slow data dT while making the inclination and offset adjustment. When control signal forming circuit 3 outputs signal ET at a high logic level, logical slow/fast circuit 18 receives temperature compensating fast/slow data dT produced by temperature compensating circuit 17 and sets the 1/1024 frequency divider circuit 20 in a gaining state determined by temperature compensating fast/slow data dT. Compensation for the secondary temperature characteristics of oscillation circuit 1 results.

Slow/fast circuit 18 is disclosed in greater detail as logic tuning circuit 13 shown in FIGS. 1 and 8 of U.S. Pat. No. 4,761,771 which is incorporated as though fully set forth herein by reference thereto.

When reset switch 25 is closed, the reset mode is maintained until a pulse is applied to terminal T1 at which time signal RE becomes low and mode counter 5 begins to count. Reset signal RS assumes a high logic level resulting in frequency divider circuit 2 being reset to its initial state.

When consecutive pulses are applied to terminal T1 while reset switch 25 remains closed, the count value of mode counter 5 is incremented. Therefore, the mode changes from test mode 1 to test mode 2, test mode 3, . . . . Reset signal RS changes to a high logic level when the test mode changes and simultaneously resets frequency divider circuit 2 and EPROM data counter 9 to their initial states. Consequently, it becomes possible to confirm the function, data writing to EPROM 8 and to confirm the data without restoring the reset mode each time.

In test mode 1, reset signal RS is at a low logic level which permits frequency divider circuit 2 to operate. Subsequently, mode signal M1 assumes a high logic level and output control circuit 13 selects the 16 Hz signal $\phi$16 as signal S01 and output signal $\phi se$ of temperature sensitive oscillation circuit 16 as signal S02. Signals $\phi$16 and $\phi se$ are applied to terminals 01, 02 of motor driving and detector circuit 15, respectively. The operation of logical slow/fast circuit 18 is suspended during test mode and, by monitoring $\phi$16, the pace at the time oscillation circuit 1 is not being compensated can be measured. Constants B and ft of eq. 3 can be computed by measuring temperature pace y and temperature sensitive oscillation frequency f at three temperature points using test mode 1.

During test mode 2, IC 100 is checked to determine if it is operating in accordance with the data of K1-K4 written into EPROM 8. Mode signals M (2, 3), M (0, 2, 3), M (N, 2, 8-11) are now at a high logic level, terminal T3 of input/output control circuit 7 receives an accelerating test clock signal TCL2k equivalent to the 2048 Hz signal $\phi$2K of frequency divider circuit 2. Data selector 10 selects the data of EPROM 8. Output control circuit 13 selects the motor driving pulse which is supplied to output terminals 01, 02 of motor driver and detector circuit 15.

Mode signals M (2, 3), M (3-7), M (0, 2, 3) assumes a high logic level during test mode 3. Terminal T2 of input/output control circuit 7 receives data clock signal TCLROM of EPROM data counter 9. Except for the selection by data selector 10 of data produced by EPROM data counter 9, test mode 3 is similar to test mode 2 in operation. Since data selector 10 is operable for selecting the data of EPROM data counter 9 and since IC 100 can receive accelerating test clock signal TCL2K separately from data clock TCLROM, testing of reference data (i.e., signal L) at an accelerating rate can be conducted. Proper operation of IC is confirmed without writing the data of K1-K4 into EPROM 8.

In test modes 4-7, the data of K1-K4 is written into EPROM 8. Mode signals M (3-7) and M (4-11) other than M4-M7 assume a high logic level , whereas M (N, 2, 8-11) assumes a low logic level. Terminal T2 of input/output control circuit 7 receives data clock TCLROM of EPROM data counter 9. Terminal T3 receives test clock TCL1/10 equivalent to the 1/10 Hz signal $\phi$1/10 of frequency divider circuit 2. output control circuit 13 selects the output data of signal L (i.e., the reference data produced from EPROM data counter 9). Selection by circuit 13 is in accordance with the contents of the 1/32 frequency divider circuit 23 (the number of inputs from test clock TCL1/10) and has terminals 01, 02 receive such output data. Consequently, the contents of data that should be written into EPROM 8 are confirmed at output terminals 01, 02 before being written into EPROM 8. Once confirmed, the new data can be written into EPROM 8.

In test modes 8-11, the data of K1-K4 written into EPROM 8 is confirmed. Since the mode signals M (4-11) and M (N, 2, 8- 11) other than M8-M11 assume a high logic level, terminal T3 of input/output control circuit 7 receives test clock TCL1/10 equivalent to the 1/10 Hz signal 01/10 of frequency divider circuit 23. Output control circuit 13 selects output data d1-d10 (i.e. the data of EPROM 8) in accordance with the contents of the 1/32 frequency divider circuit 23 (the number of inputs of the test clock TCL1/10) with terminals 01, 02 receiving output data $d_1$-$d_{10}$.

IC 100 when used in an analog electronic timepiece can The arranged for optimum performance within the timepiece by controlling the needle operating period of the step motor, the driving pulse width, and the detecting pulse width using the motor driving signal control data K1 written into the EPROM 8. IC 100 can be used for different types of timepieces. Moreover, by arranging motor driving signal control data K1 in parallel to pace adjusting data K2, inclination adjusting data K3 for temperature compensation and offset adjusting data K4, there is no need to increase the wiring area when the output line is placed for common use. Mode counter 5 and decoder 6 permit each item of data to be written and confirmed in different modes. Terminals T2, T3, 01, 02, and W are for common use in their respective modes. Terminals T2, T3, 01 and 02 are used simultaneously wherein the input/output terminals can be used for other functions. The number of additional pads is minimized. The additional functions also contribute to minimizing any increase in the size of IC 100.

In test mode 3, operation of IC 100 using reference data (i.e., signal L) is confirmed by supplying reference data to terminal T2 which in turn supplies the same as test clock TCLROM to EPROM data counter 9. In accordance with time control signals EK1-EK4, the reference data is produced by data selector 10 rather than control data K1-K4 All operations of IC 100 can be confirmed without erasing the data of EPROM 8 each time by using irradiating ultraviolet rays.

Reference data L is confirmed by monitoring terminals 01, 02 while supplying test clock TCL1/10 from terminal T3 in each data writing mode when control data K1-K4 is written into EPROM 8. Errors in the data writing mode due to the data being inverted because of noise are prevented.

As now can be appreciated, the function of IC 100 for an electronic timepiece as well as the timepiece itself can be examined by checking reference data L held by the reference holding means (i.e., counter 9) using the reference data output means (terminals 01 and 02) prior to and while control data K is written into the EPROM. Writing of erroneous data into EPROM 8 is prevented by again setting the reference data L (when the data is miscarried because of noise) . Furthermore, the yield rate is vastly improved even when using high-performance electronic timepieces incorporating EPROMS.

As also can be readily appreciated, the function of IC 100 for an electronic timepiece can be tested by changing reference data L of the reference holding means in the test mode B (i.e. test mode 3) without rewriting control data K of EPROM 8. The test time is thus shortened making IC 100 less expensive than conventional ICs for analog electronic timepieces. Since every combination of EPROMs can be tested, the level of quality of IC 100 also significantly improves.

These advantages are particularly important because the erase time is especially long provided the EPROM is of an ultraviolet ray erase type. EPROM 8 can be produced using the process employed for manufacturing ICs for electronic timepieces in general. A further reduction in the price of IC 100 results.

The motor driving signal period and pulse width are selected using any suitable value of control data K1 stored in EPROM 8 by slight increments or decrements in the voltage applied to the pad when writing data into EPROM 8. IC 100 can be employed in various kinds of analog electronic timepieces without increasing the size of IC 100.

The production cost of IC 100 can be significantly lowered as the number of ICs produced increases based on repetitive use of the same jigs and testing equipment. A reduction in the Price of IC 100 results. IC 100 can be made to conform to almost all motor-driven specifications which contributes to reducing the time and expenses for developing and designing an analog electronic timepiece.

IC 100 permits optimum drive specifications to be maintained even though variations in motor characteristic exists. Manufacture of high-quality analog electronic timepieces is achieved.

The foregoing advantages are further enhanced by arranging the EPROM for storing control data K1 in parallel to the EPROM for storing control data K2 for use in controlling the other functions to permit the use of a common data line. Still further improvement can be achieved by writing control data K1, K2 in different individual modes with common terminals being used for writing in each mode. The need to increase the size of IC 100 is substantially minimized due to the reduction in wiring area and the number of pads required.

The analogue electronic timepiece including IC 100 provides under test mode 1 a driving signal (016) for driving step motor 26 while at the same time monitoring the output of IC 100 a terminals $0_1$ and $0_2$ to determine if compensation, if any, is needed. During test mode 2, IC 100 is checked to determine if it operating in accordance with the data of K1–K4 stored in EPROM 8 at an accelerated test rate using signal TCL 2k supplied through input/output control circuit 7 for driving frequency divider circuit 2 rather than being driven by the output of oscillator 1. In other words, testing occurs at an accelerated rate based on the data stored in EPROM 8.

During test mode 3, IC 100 is tested at an accelerated rate based on reference data (i.e., signal L) without writing the reference data into EPROM 8 to determine whether such reference data provides the desired output at terminals $0_1$ and $0_2$. During test modes 4–7, the reference data which is desired to be written into EPROM 8 is first checked across terminals $0_1$ and $0_2$ prior to being written into EPROM 8. Accordingly, any erroneous reference data created by, for example, noise can be detected prior to being written into EPROM 8 so that the erroneous data is not written into EPROM 8. Once the reference data is confirmed as being correct, the same can then be written into EPROM 8. During test modes 4–7, terminal T3 receives test clock TCL/10 which serves as the input to frequency divider circuit 2 rather than the output from oscillator 1. During test modes 8–11, the data of K1–K4 which is stored in EPROM 8 is confirmed. Terminal T3 receives test clock TCL 1/10 which serves as the input to frequency divider circuit 2 rather than the output from oscillator 1.

The various test modes therefore permit IC 100 based on the information held in counter 9 or stored in EPROM 8 to be tested. If necessary, to provide proper operation of the analogue electronic timepiece, the control data stored in EPROM 8 can be changed. Advantageously, testing of the control data stored in EPROM 8 and of any corrective data, held in counter 9 (i.e., reference data) can be tested at an accelerated rate. Furthermore, the reference data prior to being stored in EPROM 8 can be tested to confirm its accuracy. After storage in EPROM 8, the control data can be tested to confirm its accuracy once again. There is no need to constantly erase data from EPROM 8 using, for example, irradiating ultraviolet rays to determine whether the reference data is acceptable and has been properly stored in EPROM 8.

It will thus be seen that the objects set forth above, and those made apparent from the preceding description are efficiently attained and, since certain changes may be made in the above article without departing from the spirit and scope of the invention, it is intended that all matter contained in the above description and shown in the accompanying drawings shall be interpreted as illustrative and not in a limiting sense.

It is also to be understood that the following claims are intended to cover all the generic and specific features of the invention herein described and all statements of the scope of the invention, which as a matter of language,, might be said to fall therebetween,

What is claimed is:

1. An integrated circuit for an electronic timepiece, comprising:
   - non volatile memory means for storing and producing control date;
   - volatile holding means for receiving and holding at least said control data;
   - motor driving signal forming means for selecting a motor driving signal period and pulse width based on the control data; and
   - reference data holding means for holding reference data wherein said volatile holding means is operable for receiving and holding said reference data and said motor driving signal forming means is also operable for selecting a motor driving signal period and pulse width based on the reference data.

2. The integrated circuit of claim 1, further including data selector means for selecting between control data and reference data and mode forming means for establishing at least two test modes wherein said data selector means is operable for selecting said control data during one of said two test modes and for selecting said reference data during the other of said two test modes and wherein said volatile holding means receives said control data and said reference data. based on the selection made by said data selector means.

3. The integrated circuit of claim 1, wherein said non volatile memory means includes more than one semiconductor nonvolatile type device.

4. The integrated circuit of claim 3, wherein each semiconductor nonvolatile type device is an ultraviolet ray erase type.

5. The integrated circuit of claim 4, wherein each of the semiconductor nonvolatile type devices stores and produces different control data, said devices being disposed parallel to one another and further including an output data line for common use by the devices.

6. The integrated circuit of claim 5, wherein the different control data include at least motor driving and pace regulating information.

7. The integrated circuit of claim 6, wherein the timepiece is an analog type.

8. The integrated circuit of claim 1, further including mode counter means for establishing test modes during which time the timepiece is checked and decoding means for controlling when the storing of control data into and production of control data from said nonvolatile memory means occurs based on the current test mode.

9. The integrated circuit of claim 8, further including common terminal means for writing of the control data in each test mode.

10. An electronic timepiece including an integrated circuit, said integrated circuit comprising:
   - non volatile memory means for storing and producing control data;
   - volatile holding means for receiving and holding at least said control data;

motor driving signal forming means for selecting a motor driving signal period and pulse width based on the control data; and reference data holding means for holding reference data wherein said volatile holding means is operable for receiving and holding said reference data and said motor driving signal forming means is also operable for selecting a motor driving signal period and pulse width based on the reference data.

11. The electronic timepiece of claim 10, further including data selector means for selecting between control data and reference data and mode forming means for establishing at least two test modes wherein said data selector means is operable for selecting said control data during one of said two test modes and for selecting said reference data during the other of said two test modes and wherein said volatile holding means receives said control data and said reference data based on the selection made by said data selector means.

12. The electronic timepiece of claim 10, wherein said non volatile memory means includes more than one semiconductor nonvolatile type device.

13. The electronic timepiece of claim 12, wherein each semiconductor nonvolatile type device is an ultraviolet ray erase type.

14. The electronic timepiece of claim 13, wherein each of the semiconductor nonvolatile type devices stores and produces different control data, said devices being disposed parallel to one another and further including an output data line for common use by the devices.

15. The electronic timepiece of claim 14, wherein the different control data include at least motor driving and pace regulating information.

16. The electronic timepiece of claim 15, wherein the timepiece is an analog type.

17. The electronic timepiece of claim 10, further including mode counter means for establishing test modes during which time the timepiece is checked and decoding means for controlling when the storing of control data into and production control data from said nonvolatile memory means occurs based on the current test mode.

18. The electronic timepiece of claim 17, further including common terminal means for writing of the control data in each test mode.

* * * * *